United States Patent [19]

Stefan

[11] Patent Number: 5,044,483

[45] Date of Patent: Sep. 3, 1991

[54] COIN BOX FOR A SLOT MACHINE

[76] Inventor: Alexander Stefan, 216 E. Arby Ave., Las Vegas, Nev. 89119

[21] Appl. No.: 536,322

[22] Filed: Jun. 11, 1990

[51] Int. Cl.[5] ..... G07F 9/06

[52] U.S. Cl. ..... 194/350; 222/160; 232/15; 232/43.2

[58] Field of Search ..... 194/350; 232/15, 16, 232/4 D, 43.2; 222/160, 162

[56] References Cited

U.S. PATENT DOCUMENTS

| | | | |
|---|---|---|---|
| 723,776 | 3/1903 | Hurd | 232/4 D |
| 1,454,420 | 5/1923 | Wittenberg | 194/350 |
| 2,570,920 | 10/1951 | Clough et al. | 232/15 X |

FOREIGN PATENT DOCUMENTS

| | | | |
|---|---|---|---|
| 683018 | 3/1964 | Canada | 194/350 |

*Primary Examiner*—F. J. Bartuska
*Attorney, Agent, or Firm*—Charles C. Corbin

[57] ABSTRACT

An open-topped coin collection box is mounted within a cabinet-like enclosure upon which is mounted a slot machine which is adapted to discharge coins downwardly to the collection box. The collection box is slidably supported on an inclined surface which slopes to an opening in the front wall of the cabinet through which the coin box, supported on the inclined surface, may slidably move outward of the cabinet enclosure under the urging of gravitational force. The coin box has a key operated lock for securing it in a fully enclosed position in which the front wall of the coin box will cover the front wall opening. The forward portion of the bottom of the box is equipped with a pivotally mounted flap which is supported against opening by virtue of engaging the enclosure's inclined surface, including when the box is releasably latched into an intermediate, partially opened position to allow inspection of box contents, and the flap is fully openable to allow discharge of coins held in the box when the box is allowed to be further withdrawn so that the flap is moved out of engagement with the inclined surface.

6 Claims, 3 Drawing Sheets

COIN BOX FOR A SLOT MACHINE

BACKGROUND OF THE INVENTION 1. Field of the Invention

The present invention relates to reservoirs for accumulating coins supplied by a slot machine, and more particularly to a coin reservoir that is removably mounted within a secured enclosure below a slot machine.

2. Description of the Prior Art

The conventional way of accumulating coins collected in a slot machine is to use a free, bucket-like container within a cabinet-like enclosure that has a lockable door through which the bucket may be inserted and removed from the enclosure. A slot machine is secured to the top of the cabinet-like enclosure, and will have a coin-discharge chute which feeds coins downwardly through an opening in the top wall of the enclosure. At regular prescribed intervals in a typical casino setting the coins accumulated by slot machines must be collected and removed for an accounting. In this typical conventional arrangement the slot machine attendant must unlock and open the cabinet door.

The attendant will often reach into the cabinet and grasp position it so as to observe whether there has been a sufficient accumulation to warrant removal of coins. If the bucket is substantially full, it is removed and taken away for an accounting of its contents and a second, empty bucket will be positioned in the cabinet to replace the one removed. A drawback with this type of structure is that it is cumbersome for the attendant to reach into the cabinet and maneuver a full bucket of coins out of the cabinet door. A full bucket of coins can be quite heavy which contributes to the difficulty in maneuvering the coin bucket and presents a potential safety hazard to the attendant. In addition it is noted that as a consequence of this problem the size of the collection bucket is deliberately limited to as to limit the amount of weight that must be handled. It is also noted that using such a conventional set up can lead to inadvertent damage to the cabinet whenever a heavy bucket is accidentally banged against it.

SUMMARY OF THE INVENTION

In view of the aforestated shortcomings and limitations it is a general object of the present invention to provide a more expedient method and apparatus for accumulating the coin proceeds of a slot machine.

Another object is to provide apparatus for collecting the coin proceeds of a slot machine in a way that is quick and safe for the slot machine attendant.

A further object is to provide apparatus that does not require a slot machine attendant to maneuver a heavy bucket from the confines of an enclosure.

A still further object is to provide, in association with a slot machine, a built-in enclosed coin reservoir which is mounted so that its level of contents can be easily and conveniently visually checked as desired.

Still another object of the invention is to provide for a slot machine, a coin reservoir that can have a capacity substantially larger than conventional buckets so that the slot machine will need servicing on a less frequent basis.

Yet another object is to provide for a slot machine a coin reservoir that can be withdrawn from its secured position under the assistance of gravity.

These and other objects and advantages are provided by the present invention which includes an open-topped coin collection box that is mounted in drawer-like fashion within a cabinet-like enclosure upon which a slot machine is mounted and adapted to discharge coins downwardly to the collection box. The box is mounted on downwardly and forwardly sloped support and guide means that extend towards an opening in the front wall of the enclosure, which structure allows the box to be urged by gravitational force outwardly of the enclosure from the box's fully enclosed position in which the front wall of the box covers the enclosure opening, and in which position the box is aligned to receive coins from the slot machine above.

On the forward part of the box bottom is a transversely extending flap which is normally supported in a closed configuration by virtue of support from the sloped support and guide means. This flap is pivotable by gravitational force to create a coin-passing opening when the box is moved sufficiently outwardly so as to carry the flap beyond its under support. There is lock means for releasably locking the cash box in its fully enclosed position. The invention also includes a releasable latch which holds the box against further outward movement beyond a partially withdrawn position in which the flap is supported below by the sloped support means and in which position the open top of the box will allow an attendant to visually inspect the contents of the box. To allow a sufficiently full box to be emptied of its contents the latch may be released to allow the box to be further outwardly moved to a discharge position where the flap is carried beyond its under support which allows it to open, causing accumulated coins to discharge downwardly through the opening created and into a receptacle placed below the coin box flap. There is means operative between the box and the enclosure for holding the box against further outward movement beyond its discharge position. The lightened, emptied coin box can then be easily slid back to its closed position and locked.

DETAILED DESCRIPTION OF THE INVENTION

Figure 2:
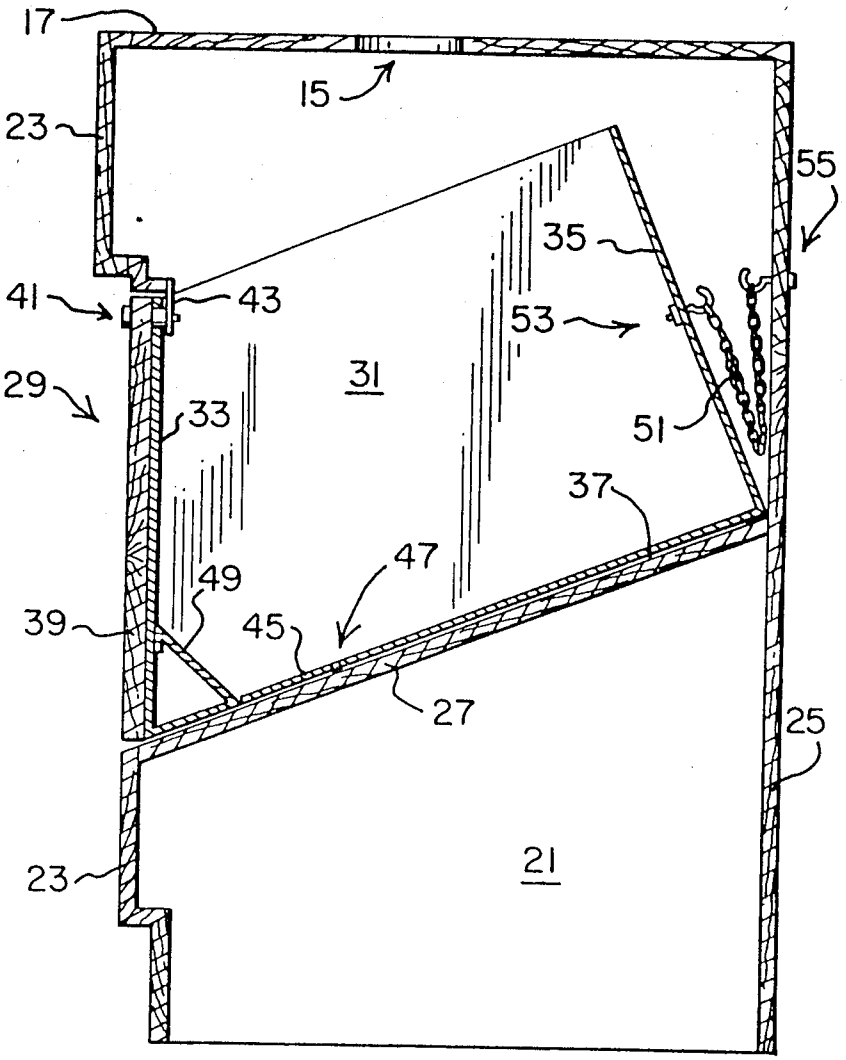
FIG. 2 is a sectional elevational view illustrating the coin box assembly of the invention in a closed and locked configuration.
Figure 1:
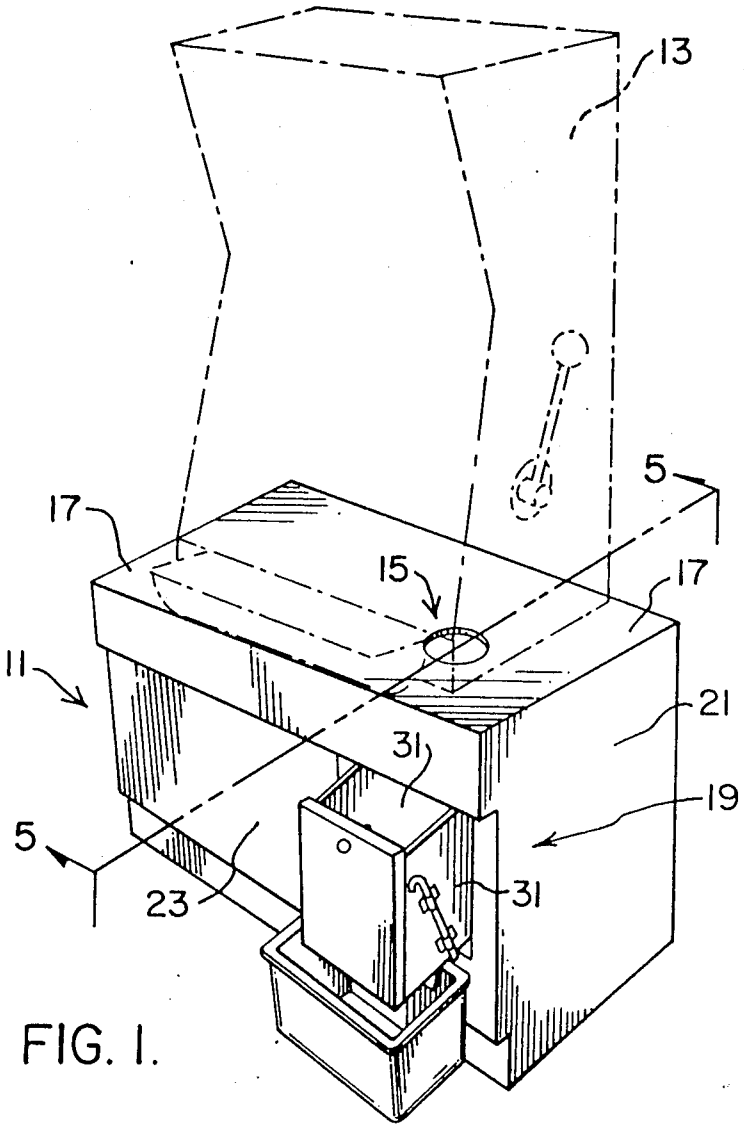
FIG. 1 is a view in perspective showing a preferred embodiment.

Referring now to the drawings, FIGS. 1 and 2 show a preferred embodiment of the coin box assembly 11 used in association with a conventional slot machine 13 that is equipped to discharge coins downwardly through an opening 15 in the top wall 17 in a cabinet-like enclosure 19 upon which the slot machine is mounted. The cabinet-like enclosure 19 may be of wood construction including spaced-apart side walls 21, rear wall 25, and front wall 23. Affixed within enclosure 19 is a sloped member 27 that provides a smooth upper surface for supporting a collection drawer 29 that is substantially fabricated of steel with side walls 31, front wall 33, rear wall 35, and bottom wall 37. A wooden front panel 39 is affixed to the metallic front wall 33 and will completely fill a drawer-passing opening in the front wall 23 when the collection drawer 29 is in the position shown in FIG. 2. In the closed and locked position so illustrated a conventional cam lock 41 is in a locked position with a latch member 43 engaging cabinet structure to hold the drawer 29 in place as shown.

Note that the collection drawer 29 is open-topped and the closed position shown in FIG. 2 it is aligned below the coinpassing opening 15. Further note that the bottom structure of collection drawer 29 features a transversely extending metallic flap 45 which is pivotally attached by conventional hinge means 47 to the lower edge of bottom wall 37 in a manner that will permit it to swing downwardly in a manner to be described hereinafter when its underside is not supported. Further note that the forward lower portion of collection drawer 29 is equipped with a rearwardly sloped metallic wall panel 49 which will be seen to serve to funnel coins towards the flap 45 and the opening that will be created when flap 45 is opened in a manner to be described.

Figure 5:
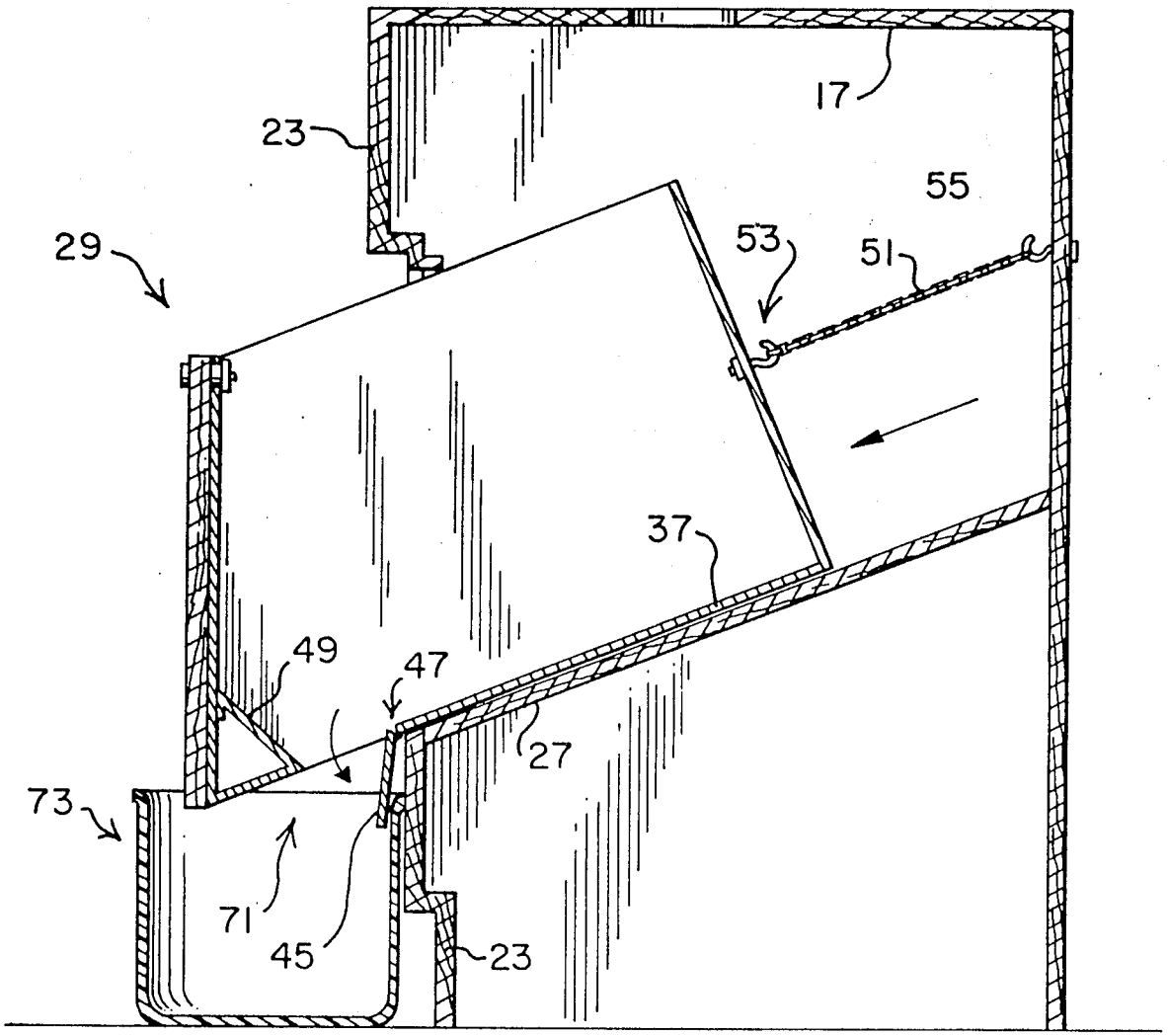
FIG. 5 is a sectional view taken along the line 5—5 of FIG. 1.

A strong, flexible restraining member 51, which may be steel chain as shown or a suitably strong and durable fiber reinforced strap of synthetic material, is anchored to the drawer rear wall 35 by a conventional fixture 53 at one end, and to the rear wall 25 by conventional fixture 55 at its other end. It will occur to those of ordinary skill in the art that within this invention there are several equivalent ways of restraining the drawer 29. For example, stop means may be provided within said enclosure for abutting fixed structure on the drawer when it is extended as shown in FIG. 5. In the locked, closed position shown in FIG. 2 the collection drawer 29 is completely secured within the cabinet 19 and will accumulate coins fed to it via the opening 15.

Figure 4:
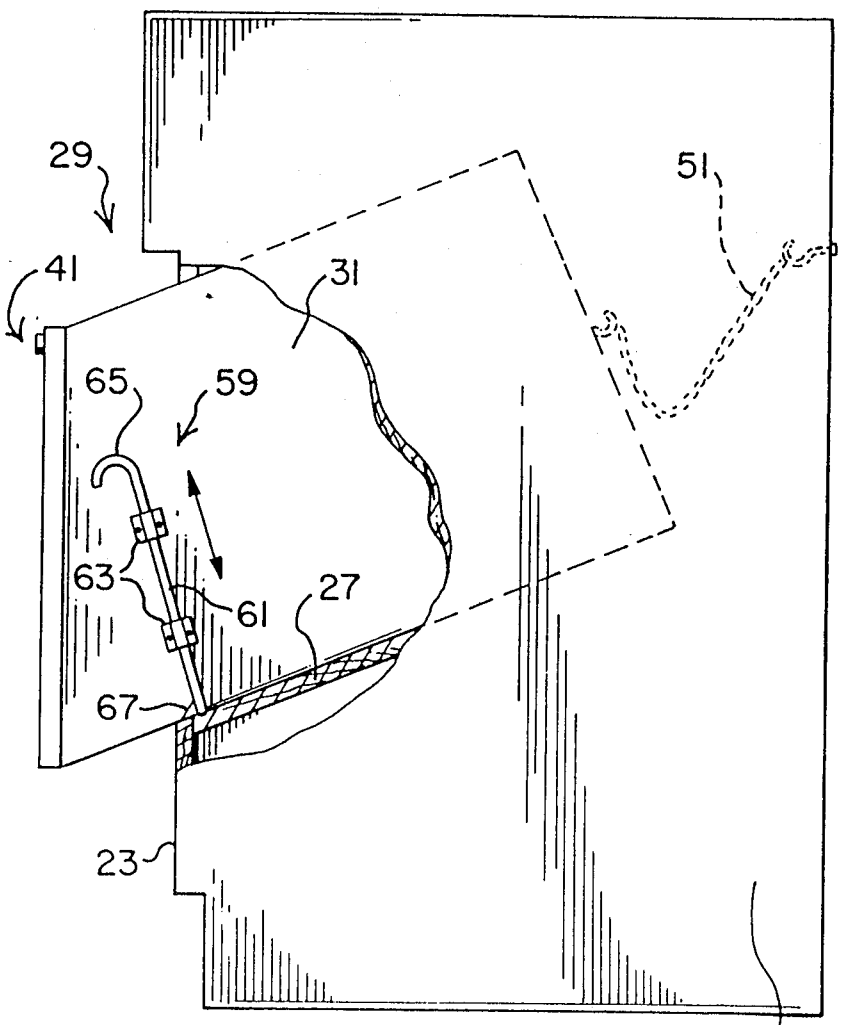
FIG. 4 is a partially sectional, elevational view with parts broken away for clarity, showing a collection box held in the partially opened position of FIG. 3.
Figure 3:
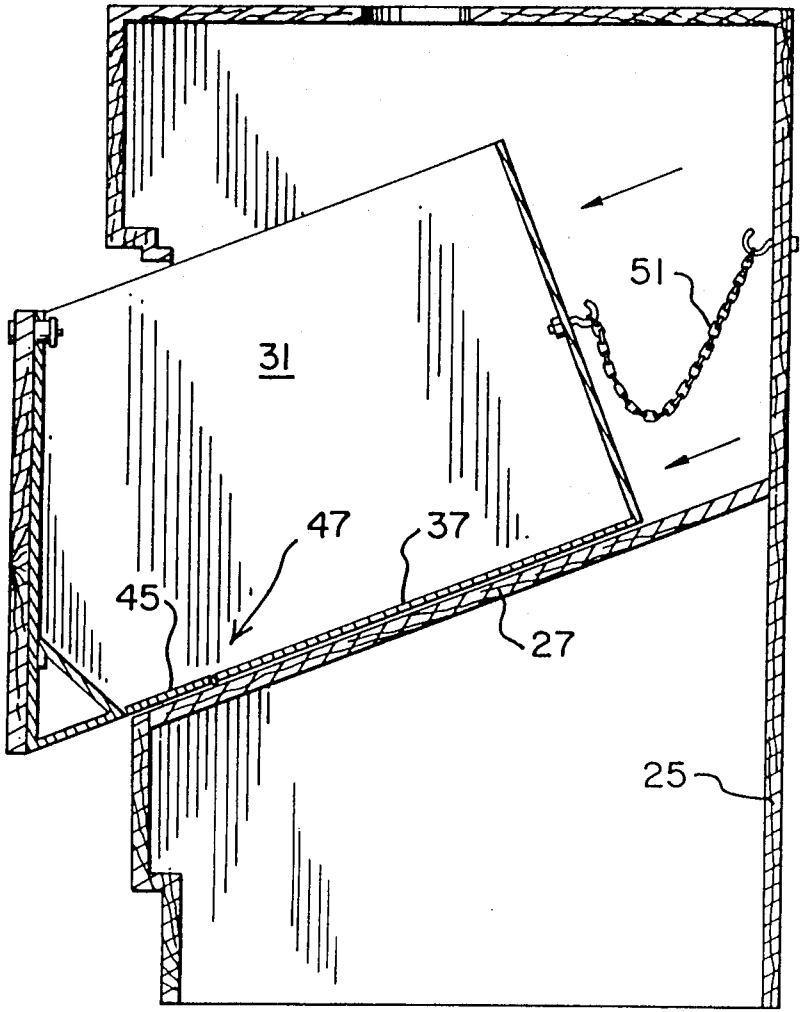
FIG. 3 is a sectional elevational view illustrating the coin box of the invention as held in a partially opened position, for visible inspection.

When the cam lock 41 is unlocked the collection drawer 29 is unlatched and is free to slide forwardly and downward for a distance under the urging of gravity. A hand operated latch 59, shown in FIG. 4, is mounted to the exterior of a first side wall 31 of the collection drawer 29 and includes member 61 that is mounted for movement in the sleeves carried on brackets 63. There is a handle 65 at the top of the latch member 61. Also note that there is a stop 67 attached to the cabinet and aligned so that the lower end of latch member 61 will abut it to hold the collection drawer 29 against further outward movement beyond the position shown in FIG. 4. Thus the latch 59 is adapted to hold collection drawer 29 in an intermediate, partly opened position with sufficient outward extension to allow an attendant to view its contents through its open top. Drawer 29 will also be sufficiently withdrawn to give the attendant access to the latch handle 65. FIG. 3 shows that when drawer 29 is in this intermediate, inspection position, the flap 45 is fully supported in closed position by the underlying inclined member 27. It will be apparent to those experienced in the art that equivalent latching means to the hand-operated latch 59 can be devised to releasably latch such a partially opened drawer.

FIG. 5 illustrates collection drawer 39 in its fully opened position, which position is held by the taut restraining chain 51. It is noted that the flap 45 has been moved sufficiently outward so as to lie beyond the supporting edge of the inclined member 27, thereby being free to swing downwardly to create an opening for passing coins from drawer 29. Also note how the inclined panel 49 and the sloped bottom 37 of collection drawer 29 converge with respect to each other forming surfaces that will funnel the contents of drawer 29 to the opening 71. The drawer 29 may be pushed to its closed position from the position shown in FIG. 5 and flap 45 is adapted to slidably engage the foremost edge portion of the inclined member 27 so as to be urged upwardly to a closed position as the drawer is being closed.

It will be apparent that drawer 29 may be locked by locking mechanism that is equivalent to what is shown. For example, other well-known means for locking a drawer may be employed.

While the preferred embodiment herein shows use of an inclined member 27, the invention encompasses other means suitable for supporting and guiding a drawer such as tongue and groove arrangements and arrangements employing the use of rollers.

In the operating of the aforedescribed preferred embodiment the collection drawer 39 can be secured in the closed position of FIG. 2 so as to accumulate coins fed to it from a slot machine by way of the opening 15. When an attendant wishes to check the level of coins collected within drawer 29 the cam lock 41 is unlocked so that drawer 29 may be slid forward, aided by gravity, to the intermediate position shown in FIG. 3 and 4. If inspection reveals the need to empty drawer 29 a portable collection box 73 is aligned below the drawer 29 adjacent front wall 23 of the enclosure. The latch handle 65 may then be raised to release the drawer so that it may be gravitationally urged to the position shown in FIG. 5. Thus, with flap 45 opened an accumulation of coins will pass through opening 71 and into the portable collection box 73 which is taken away for accounting. The empty collection drawer 29 may then be reclosed and locked in its closed position to resume its coin collection function.

While particular embodiments of the invention have been described herein it is not intended that the invention be limited thereto, since there are modifications and changes that may readily occur to those skilled in the art without departing from the invention. Therefore it is aimed to cover all such changes and modifications as fall within the true spirit and scope of the invention as defined in the claims which follow.

What is claimed is:

1. Coin receptacle and dispensing assembly for use with a slot machine, and being mountable within an enclosure below said slot machine, said enclosure adapted to allow passage of downwardly discharged coins from said slot machine, said assembly including:

a) downwardly and forwardly sloped support and guide means mounted within said enclosure, and extending towards an opening in the front wall of said enclosure;

b) coin box, open-topped and having a bottom and sidewalls including a front wall which define a coin-receiving compartment, said box adapted to engage said downwardly sloped support means for gravitationally urged movement along said guide means and outwardly of said enclosure through said opening, said box having a fully enclosed position wherein the front wall of said box covers said enclosure opening and wherein said box is aligned to receive coins discharged from said slot machine, the forward part of the bottom of said box having a pivotally mounted, transversely extending flap and mean supporting said flap in a closed configuration when it lies inwardly of said enclosure, and said flap being pivotable to create a coin-passing opening in said bottom when said box is moved outwardly sufficiently to carry said flap beyond said means supporting said flap;

c) lock means for releasably locking said cash box in its fully enclosed position;

d) releasable latch means for holding said box against further outward movement beyond a partial withdrawn position for partially exposing the open top of said box to allow viewing of said compartment and in which position said flap is held closed, said box being outwardly movable to a discharge position when said latch is released, in which discharge position said flap is moved beyond said flap support means to allow it to open; and e) stop means operative between said box and said enclosure for limiting further movement of said box outwardly beyond its discharge position.

2. Assembly as defined in claim 1 wherein said sloped support and guide means comprises a sloped surface and the bottom of said coin box is adapted to slidably engage said surface.

3. Assembly as defined in claim 2 wherein said means for supporting said flap comprises said inclined surface.

4. Assembly as defined in claim 2 wherein said inclined surface extends to the lower edge of said opening.

5. Assembly as defined in claim 1 wherein the forwardmost interior surface of said box bottom provides a rearwardly sloped surface adjacent to said flap.

6. Assembly as defined in claim 1 wherein said latch means is fully enclosed and inaccessible when said box is in its fully enclosed position, and wherein said latch it accessible by hand when said box is held in its partially opened position.

* * * * *